United States Patent [19]

Morel et al.

[11] 4,049,528

[45] Sept. 20, 1977

[54] METHOD AND A DEVICE FOR THE SUPPLY OF ELECTRIC CURRENT TO TRANSVERSE IGNEOUS ELECTROLYSIS TANKS TO MINIMIZE EFFECTS OF MAGNETIC FIELDS

[75] Inventors: Paul Morel, Le Vesinet; Jean-Pierre Dugois, Saint Jean-de-Maurienne, both of France

[73] Assignee: Aluminum Pechiney, Lyon, France

[21] Appl. No.: 670,898

[22] Filed: Mar. 26, 1976

[30] Foreign Application Priority Data

Sept. 18, 1975 France ..... 75.29181

[51] Int. Cl.[2] ..... C25C 3/06; C25C 3/00

[52] U.S. Cl. ..... 204/243 M; 204/64 R; 204/67

[58] Field of Search ..... 204/243 M, 67, 64

[56] References Cited

U.S. PATENT DOCUMENTS 3,775,281 11/1973 Hatting ..... 204/243 M 3,874,110 2/1959 Thayer ..... 204/243 M

*Primary Examiner*—John H. Mack
*Assistant Examiner*—H. A. Feeley
*Attorney, Agent, or Firm*—McDougall, Hersh & Scott

[57] ABSTRACT

The invention relates to a method and a device for supplying electric current to igneous electrolysis tanks.

According to the method, each element, front and rear, of the upstream collector is divided into two parts, one end part 19–20 and the other the central part 17–18, and the tank is supplied by four risers, including two end risers 23–24 and two central risers 25–27 and 26–28; each central riser comprises two elements 25 and 27 located in the same plane parallel to the plane of symmetry (XX) and situated respectively at ¼ and ¾ of the length of the cathode, one 25 of these elements passing under the upstream tank 13.

The invention applies to igneous electrolysis tanks and more particularly to those intended for the manufacture of aluminium.

7 Claims, 5 Drawing Figures

METHOD AND A DEVICE FOR THE SUPPLY OF ELECTRIC CURRENT TO TRANSVERSE IGNEOUS ELECTROLYSIS TANKS TO MINIMIZE EFFECTS OF MAGNETIC FIELDS

The present invention which is the result of the research of Messrs. Paul Morel and Jean-Pierre Dugois relates to a method and a device for the supply of electric current to transverse igneous electrolysis tanks.

It concerns the sector of the electrolytic production of metals.

An igneous electrolysis tank comprises a rectangular crucible of which the bottom constituting the cathode is formed by sealed blocks of carbon on metal bars parallel to the small side of the tank. The cathode is supplied with electric current by one or more negative conductors, called "collectors". On the crucible there is fixed a super structure comprising horizontal cross-pieces parallel to the large side of the tank from which the carbon anodes are suspended. The crucible contains an electrolysis bath constituted essentially by aluminium oxide dissolved in cryolite. The horizontal anode bars are fed with electric current by one or more positive supply conductors called risers. Under the effect of the passage of current, the aluminium oxide decomposes into aluminium which is deposited on the cathode and into oxygen which combines with the carbon of the anodes. A part of the bath is solidified on contact with the side walls of the crucible, thus forming an electrically and thermally insulating ridge. In the event of the tanks being arranged transversely, i.e., with their large side at right angles to the general direction of the current in the row of tanks, the ends of the cathodic bars are said to be upstream or downstream depending on whether they issue from the upstream or downstream side of the tank in relation to the general direction of the current.

The tanks are connected in series, the cathodic collectors of an upstream tank being linked to the anodic risers of the neighbouring downstream tank.

The passage of the electric current in the feed conductors and in the conducting parts of the tank produces magnetic fields which cause movements in the liquid metal and the deformation of the metal-electrolysis bath interface, thus disrupting the working of the tank. It is important to reduce to a minium the effects of these magnetic fields.

The solution to this problem is in the judicious choice of the situation of the supply conductors.

According to a first known solution, the supply of the anodes is effected by risers arriving laterally on the heads of the tank.

According to a second known solution, the supply is effected by two risers situated respectively $\frac{1}{4}$ and $\frac{3}{4}$ along the length of the tank, with the collector of the upstream tank situated opposite the downstream tank passing around each head of the upstream tank to return in the space enclosed between the two tanks toward the corresponding riser of the downstream tank.

The results obtained from these two methods only provide partial solutions, the advantages of one corresponding more or less to the disadvantages of the other.

The object of the invention is a method for the supply of electric current to igneous electrolysis tanks, minimising the effects of magnetic fields.

Another object of the invention is constituted by a supply device for the implementation of this method.

The method according to the invention applies to rectangular tanks comprising on the one hand a crucible of which the bottom constituting the cathode is formed from sealed carbon blocks on metal bars parallel to the small side of the tank, and on the other hand an anode provided with carbonaceous anodic blocks suspended from one or the other of two metal cross pieces parallel to the large side of the tank. According to this method, a first cross piece of a downstream tank is supplied from the upstream end of the cathodic bars of the neighbouring upstream tank, simultaneously by the large and small sides and the other cross piece is fed from the downstream end of the cathodic bars of the upstream tank, by the large side only, in such a way that the magnetic fields created by the various supply conductors cancel one another out.

Preferably, the first cross piece of the downstream tank should be the upstream cross piece, the second being the downstream cross piece.

The device according to the invention comprises symmetrical risers two by two in relation to the common plane of symmetry (XX) of the tanks and connecting the cathodic collectors, composed of two elements, one front and the other rear of the upstream tank to the cross pieces of the downstream tank. Each element of the upstream collector comprises a central part and an end part. The risers number four, namely two end risers, one rear one front, joining the ends of the outside parts of the upstream collector of the upstream tank to the ends of the downstream cross piece of the downstream tank, and two central risers, one front, one rear, each of which comprises two elements placed substantially in one or the other of two planes parallel to the plane (XX), these planes being situated respectively at $n$ and at $(1 - n)$of the length of the cathodes and opposite the interruptions between the central and end parts of the elements of the upstream collector, $n$ being a fraction between $\frac{1}{8}$ and $\frac{1}{4}$. The first element of each riser starts from a point of the central part of the upstream collector, passing under the upstream tank and ending at the upstream cross piece, while the second element starts from the corresponding element of the downstream collector and ends at the downstream cross piece.

Each upstream and downstream collector delivers an electric current equal to half the total current passing through the tank, the current circulating in each of the risers passing under the upstream tank being between $\frac{1}{8}$ and 3/16 of the total current I; $\frac{1}{8}$ corresponds to $n = \frac{1}{4}$ while 3/16 corresponds to $n = \frac{1}{8}$.

The invention thus defined is explained by examples illustrated by the attached figures.

Figure 4:
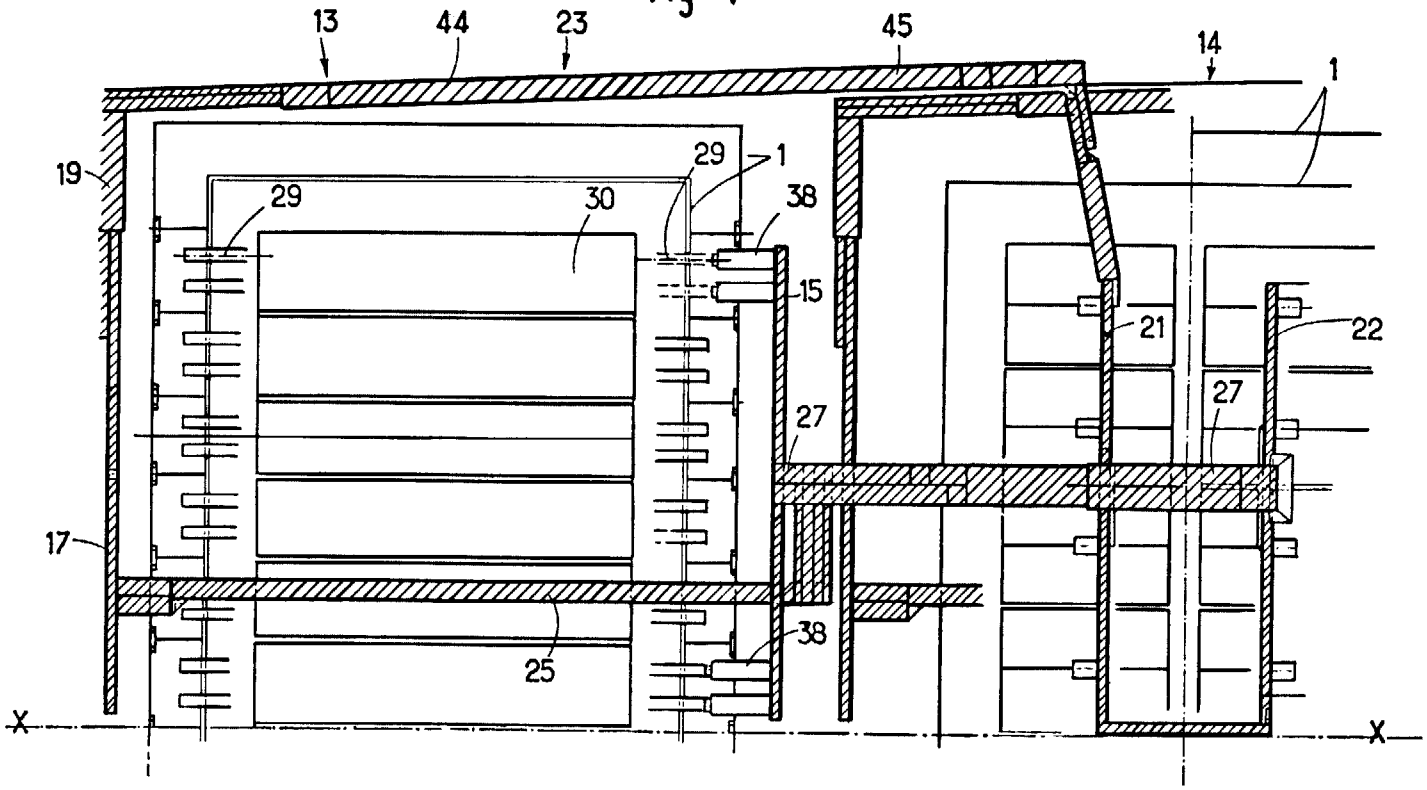
Figure 5:
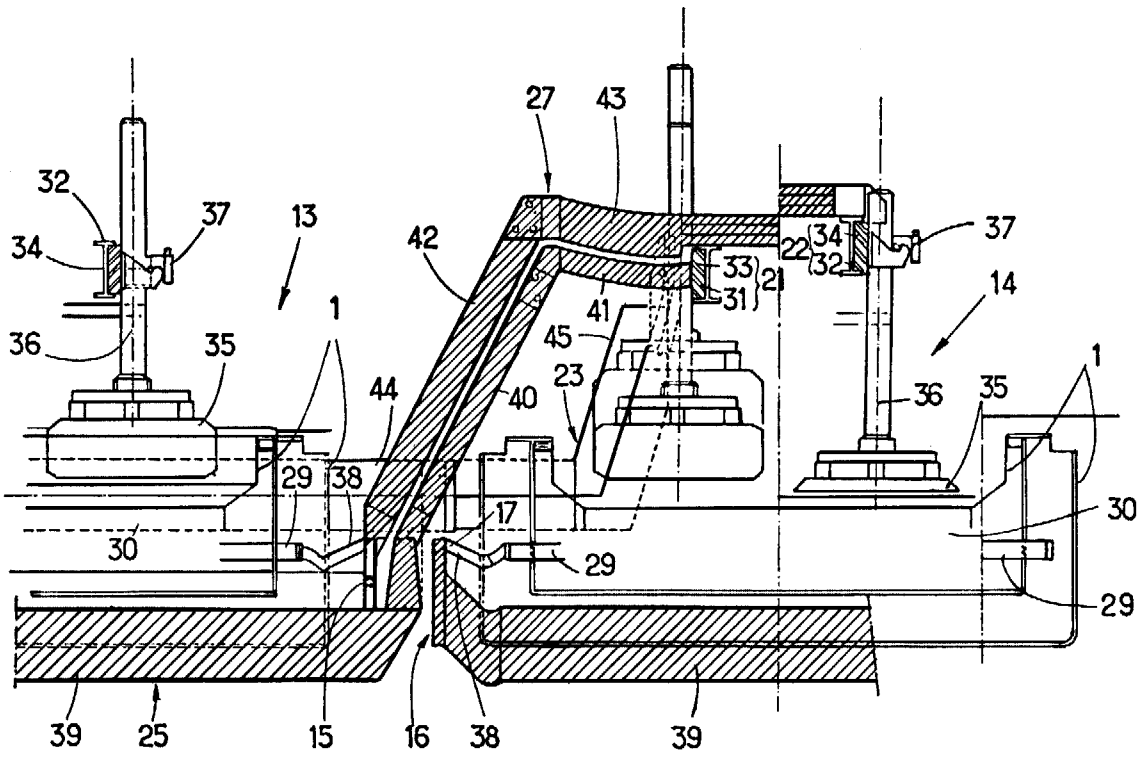

FIGS. 4 and 5 show a particular industrial embodiment. FIG. 4 shows in plan view the "rear" halves of the two tanks; FIG. 5 shows in section through a vertical plane passing through the central riser, two half-tanks limited by their respective longitudinal planes of symmetry.

In these figures, the same elements are represented by the same reference numerals.

The method applies to tanks arranged in transverse manner.

Figure 1:
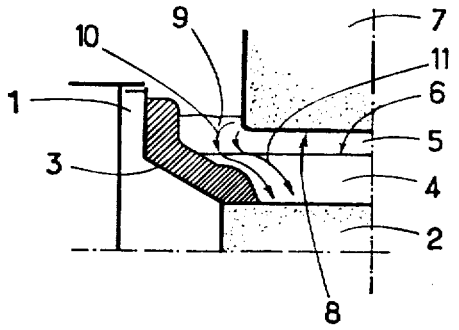
FIG. 1 is a sketch showing in section one half of an electrolysis tank.

According to FIG. 1 a tank comprises a crucible constituted by a caisson 1 and of which the bottom comprises carbonaceous blocks carried by cathodic bars and constitutes the cathode 2. The lateral wall of the caisson is coated on the inside with solidified electrolysis bath material forming a ridge 3. On the cathode there is a layer of molten metal 4 surmounted by electrolysis bath material 5 constituted by aluminium oxide dissolved in cryolite, the metal-bath interface having the reference numeral 6. The anodic system 7, termed "anode" in the following, is constituted by a plurality of parallel epipedic carbonated blocks, of which the lower faces are situated in the same plane, and termed the anodic plane 8. This anode is immersed in the bath 5, without however touching the metal-bath interface 6. A peripheral duct 9 is arranged between the anode 7 and the ridge 3.

The bath is brought to a temperature of the order of 1000° C by the Joule effect. So that the energy efficiency should be at a maximum, it is important that the energy expended for heating should be reduced to a minimum, wich necessitates the careful insulation of the tank and the reduction to a minimum of the anodic distance, i.e., the distance between the anodic plane 8 and the interface 6, so that the electrical resistance of the tank is reduced and is just sufficient to ensure the heating of the bath. It is therefore necessary that the anodic plane and the interface both be flat and horizontal, firstly to avoid any possibility of a short circuit and secondly to ensure the homogeneous distribution of the electrical currents.

However, the passage of the electrical current in the supply conductors and in the electrolysis bath produces a magnetic field which causes movements in the layer of the liquid metal 4 and the deformation of the metal-bath interface 6 which assumes the form of a dome. The result is firstly that the anodic distance is not constant which causes the heterogeneous distribution of the currents and secondly oxygen is released at the contact of the anode, reaching a maximum at locations where the anodic distance is minimal and vice-versa. This second effect causes an irregular combustion of the anode of which the anodic plane ceases to be flat.

It is therefore important to reduce to a minimum the effects of these magnetic fields.

In the calculations which follow, the starting point of the coordinates is taken to be the centre of the cathode 2, at the upper level of the carbonated blocks. The axis Ox is the transverse horizontal axis in the direction of the electrical current, Oz is the ascending vertical and Oy is such that the trihedron Oxyz, is a direct trirectangle.

$\vec{J}$ is the current density vector, and its projections on the axis Ox, Oy and Oz are respectively: $Jx$, $Jy$ and $Jz$;

$\vec{B}$ is the magnetic field vector, $Bx$, $By$ and $Bz$ being its projections on the three axes;

$\vec{F}$ is the Laplace force;

$\vec{R} = \text{Rot}\,\vec{F}$ is the rotational of the Laplace force; d1 and d2 are the densities of the bath and the metal: in general the index 1 relates to the bath, the index 2 to the metal;

$\vec{g}$ is the gravity vector;

$\vec{\Delta}$ is the vector having at its components:

$\delta/\delta x$ $\delta/\delta y$ and $\delta/\delta z$ tank: first in a static effect, due to the force:

$\vec{F} = \vec{J} \wedge \vec{B}$ and leading to a deformation in the form of a dome of the bath-metal interface 6, of which the slope is:

$$\frac{\delta z}{\delta x} = \frac{J_2 y\, Bz}{(d2 - d1)g}$$

$$\frac{\delta z}{\delta y} = \frac{-J_2 \times Bz}{(d2 - d1)g}$$

and secondly a dynamic effect, due both to the force $\vec{F} = \vec{J} \wedge \vec{B}$ and to Rot $\vec{F} = (\vec{B}\vec{\Delta})\,\vec{J} - (\vec{J}\vec{\Delta})\,\vec{B}$ This second effect can be schematised by considering separately firstly the vertical component Bz of the magnetic field and its horizontal component Bxy which can be materialised by a circular field rotating in retrograde direction, and secondly the vertical component $Jz$ of the current density and its horizontal component $Jxy$ which is generally centrifugal in the tank, except on the periphery of the anode 7 where, according to the width of the peripheral duct 9, the position of the ridge 3 and the height of the bath 5, Jxy can vary in intensity and in direction. Table No. 1 gives the direction of the Laplace forces.

TABLE NO. 1

| CURRENT DENSITY | | Magnetic Field Bxy | Magnetic Field Bz |
|---|---|---|---|
| Jxy | centrifugal | vertical descending | direct or |
| | Centripetal | vertical ascending | retrograde |
| Jz | | centripetal force | no action |

As the tank is symmetrical in relation to the plane $xOy$, it is found that if one disregards the other lines of tanks, the fields are antisymmetrical, i.e., at any point of the tank if $y$ is changed into $-y$:

$Bx$ becomes $-Bx$ $By$ remains unchanged $Bz$ becomes $-Bz$

— at the centre, the rotational of the Laplace forces has a very simplified expression and is written in the case of the tank being balanced, i.e., when:

$Jx\,(0) = 0$ :

$Rx = 0$ $$Ry = By\frac{\delta Jy}{\delta y} - Jz\frac{\delta By}{\delta z}. \qquad \text{(equation 1)}$$

$$Rz = By\frac{\delta Jz}{\delta y}:$$

If the tank is balanced and Jx is zero along the large axis, Jy = 0 at the centre, by symmetry, hence:

$$\frac{dJ}{dy} = 0 \text{ thus } \frac{\delta Jx}{\delta y} + \frac{\delta Jy}{\delta y} + \frac{\delta Jz}{\delta y} = 0$$

However, as $(\delta Jx/\delta y) = 0$, since $Jx$ is 0 on the $Oy$ axis, there results:

$$\frac{\delta Jz}{\delta y} = -\frac{\delta Jy}{\delta y}, \text{ hence : } Rz = -By\frac{\delta Jy}{\delta y}$$

The magnetic conditions for the proper running of the tanks can be described as follows:

— at the centre of the tank: By =0 (equation 2), $$\frac{\delta By}{\delta z} = 0 \quad \text{(equation 3).}$$

As the coefficient $\delta Jy/\delta y$ in equation 1 is unimportant in the case of the transverse tanks, since the current is longitudinal, the condition of equation 3 is more important than that of equation 2.

Under the anode: Bz should be at a minimum so as to reduce the dome deformation: B*xy* has less importance because in the bath 5 under the anode 7, except in the case of the deformation of the latter, there is only a reduced current density, considering the degree of the resistivity of the bath. The only horizontal current densities are therefore in the metal; they are centrifugal and with the horizontal magnetic field give forces which are directed downwards and therefore without disadvantage.

For the action on the vertical current not to give rise to movements, the forces and therefore the fields must balance one another out. The symmetry of the tank permits symmetrical fields in relation to the plane *x*Oz. There must also be equalibrium between the fields upstream and downstream of the tank.

In the peripheral duct: Bz must be sufficiently low so that there is no circular displacement of the bath, under the effect of the horizontal components of the current always present in this zone: see the arrows 10 and 11 which materialise this current. In addition, it is necessary that Bz should not everywhere have the same sign on a half-tank, so as to avoid the setting in rotation of the bath and of the metal on the heads. Indeed, the horizontal component of the current is centrifugal in the bath and centripetal in the metal. It can therefore be seen that a vertical magnetic field which would be for example constantly ascending, creates a constantly retrograde circular force in the bath and a constantly direct circular force in the metal which is obviously to be entirely avoided.

Always in the peripheral zone 9, the field Bxy is circular and retrograde while the horizontal current is centrifugal in the bath and centripetal in the metal; the corresponding Laplace force is therefore vertical and descending in the bath and vertical and ascending in the metal; everything takes place as if the specific mass of the bath were increased while reducing that of the metal. As this happens in the least hot zone of the tank in the neighbourhood of the walls of the caisson 1, where the densities of the bath and of the metal are close, the bath-metal inversion is thereby favoured.

It is therefore important, in so far as the horizontal electrical current in the peripheral duct cannot be avoided, to limit the amplitude of the horizontal field.

In conclusion, the magnetic conditions to be respected are as follows:

at the centre of the tank: d B*y*/*dz* = 0 B*y* = under the anode:

Bz minimum

B*xy*, same amplitudes and opposite signs between the upstream and downstream sides;

peripheral duct:

Bz minimum B*xy* minimum.

Figure 3:
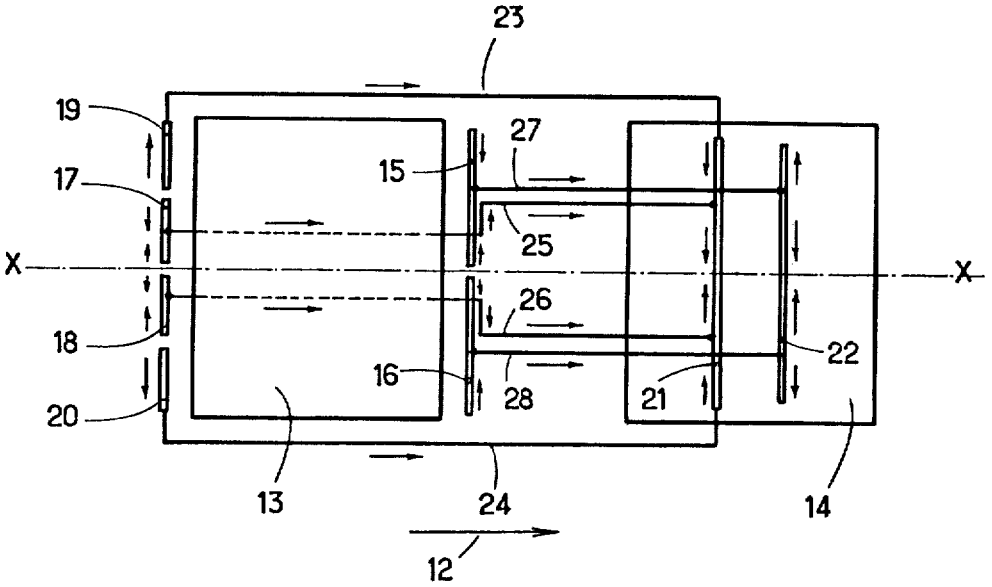
FIG. 3 is a sketch showing two tanks and their connecting conductors.

In order to fulfil these conditions, the risers are multiplied according to FIG. 3, in which the general direction of circulation of the current is given by the arrow 12 and which represents the electrical connection between one upstream tank 13 and one downstream tank 14.

The cathodic bars of the tank 13 are connected at each of their ends to a collector. The downstream collector located at the side of the tank 14 comprises two elements, one rear 15, the other front 16, which are symmetrical in relation to the common plane of symmetry (XX) of the tanks. The upstream collector, situated on the opposite side comprises two similarly symmetrical elements, each of which consists of two parts. Therefore it comprises four parts including two central parts, one rear 17, the other front 18, which are symmetrical in relation to the plane (XX) and two end parts, one rear 19, the other front 20, which are also symmetrical in relation to the plane (XX). The interruptions between the central parts and the neighbouring end parts are located respectively at *n* and at (1 − *n*) of the useful length of the tank, which is that of the cathode, *n*being a fraction between $\frac{1}{8}$ and $\frac{1}{4}$.

The anode blocks of the tank 14 are suspended from two electrically conductive cross pieces 21 and 22 arranged in the direction of the length of the tank. The cross pieces of the tank 14 are connected to the collectors of the tank 13 by four risers, symmetrical in a two by two arrangement, in relation to the plane (XX). There are two end risers, one rear 23, one front 24, each consisting of a single conductor, and two risers termed "central" located respectively at *n* and at (1 − *n*) of the length of the tank, thus opposite the interruptions 17 to 19 and 18 to 20 of the upstream collector. The ends of a first cross piece 21, which is preferably the upstream cross piece, are respectively linked to the ends of the parts 19 and 20 of the upstream collector by the end risers 23 and 24. Two points of the cross piece 21, situated respectively at *n* and at (1 − *n*) of the length of the tank are connected at two points of the central parts 17 and 18 of the upstream collector, these two latter points being preferably situated substantially at *n* and at (1 − *n*) of the length of the whole 17 - 18 of this central part, by two elements, rear 25 and front 26, of a central riser, these risers passing beneath the tank 13. The second cross piece 22, which is preferably the downstream cross piece, is itself connected to the downstream collector 15 - 16 by two central riser elements, rear 27 and front 28, one of these risers 27 connecting two points situated at *n*of the length, respectively of the collector and of the cross piece, the other 28 connecting two points situated similarly at (1 − *n*) of this length. In this way, the two elements 25 and 27 constitute the rear central riser situated at *n*of the length of the tanks, while the elements 26 and 28 constitute the front central riser situated at (1 − *n*) of the length.

It goes without saying that the tank 13 also has an anodic system consisting of two cross pieces similar to 21 and 22, connected to the collectors of the preceding tank and that the tank 14 has two upstream and downstream collectors similar to those of the tank 13 and connected to the cross pieces of the following tank.

The current circulates in the general direction passing on FIG. 3 from left to right (arrow 12), the direction of circulation in each conductor being represented by an arrow. Through each collector and each cross piece there passes half the total current passing through each tank. The current from the upstream collector is divided into two equal parts of which one passes around the head of the tank and goes towards the end of the upstream cross piece 21 of the following tank, and of which the other goes towards the central riser of the downstream tank passing beneath the upstream tank. The intensity of the current circulating in each of the risers 25 and 26 passing under the upstream tank is between one-eighth and 3/16th of the total intensity I of the current passing through the tank; the value of one eighth corresponds to $n$ " $\frac{1}{4}$ while 3/16th corresponds to $n = \frac{1}{8}$.

By moving the part of the risers 25 and 26 passing under the tank 13 parallel to themselves, which involves the displacement of the contact pickup points on the front 18 and rear 17 central parts, the value of the component By of the magnetic field can be varied at the centre of the tank: it is thus possible to cancel this component.

The ends of the collector parts situated on either side of the interruptions 17 to 19 and 18 to 20 are, when the tank presents a balanced electrical functioning, at the same potential. It is therefore advantageous to short circuit them by equipotential conductors. The interruptions 15 to 16 and 17 to 18 situated in the plane of symmetry (XX) should, however, be maintained.

Figure 2:
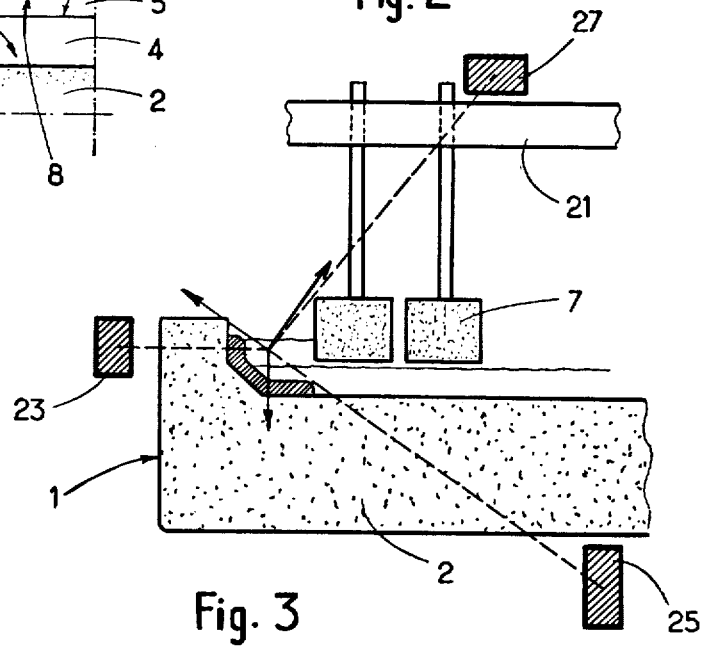
FIG. 2 is a half section showing schematically a half tank, the arrows representing the fields resulting from three conductors.

FIG. 2 illustrates the mechanism for the compensation of the magnetic fields, as used in this type of tank.

In the known tanks, the vertical field Bz is at a maximum in the corners, particularly on the upstream side of the tank. A compensation is effected between the fields created by the central risers 27, the lateral conductor 23 and the conductor 25 passing underneath the tanks. The field created by the central risers 27 is stronger upstream than downstream, as is the field created by the lateral conductor 23: the compensation is thus good over the whole of the small side of the tank. The field By is always at a maximum at the vertical of the central risers 27. The horizontal conductors situated above and below the tank are arranged at distances such that compensation is present, which reduces the value of the resultant field B*y* in the zone where it is maximum. Finally, the field B*x* created by the cross pieces is low because firstly between the central risers, centripetal currents pass through the cross pieces, and the fields are thus compensated by symmetry, and secondly, at the ends of the tank, the two cross pieces are each passed through by opposite currents and their fields also compensate one another.

The FIGS. 4 and 5 show a practical embodiment. FIG. 4 is a plan view which of the tanks 13 and 14 shows only the rear half situated above the axis (XX) of the series. The front half, not shown, can be deduced from this by symmetry in relation to this axis.

In each of the two tanks shown there is the crucible constituted by a caisson 1 and of which the bottom is constituted by the cathode comprising the cathodic bars 29, supporting the carbon blocks 30. The anodic system comprises the upstream 21 and downstream 22 cross pieces, of which each is composed of a I bar 31 and 32, to which there is attached an aluminium plate 33 and 34. The anode is constituted by anodic blocks of carbon 35 fixed to the end of stems 36, which themselves are held against the plates 33 - 34 by clips 37.

The cathodic collectors are connected to the cathodic bars 25 by connectors 38. The rear element, the only one visible, of the upstream collector comprises the rear central part 17 and the end rear part 19. The rear central part 17 is connected to the upstream cross piece 21 of the following tank by the first rear central riser element 25. This comprises a lower horizontal element 39 passing underneath the upstream tank 13, an oblique element 40 situated in the space between the two tanks 13 and 14 and an upper horizontal element 41 ending at the upstream cross piece 21, i.e., 31 - 33. The rear element 15 of the downstream collector is connected to the downstream cross piece 22 of the following tank by a second rear central riser element 27 comprising an oblique element 42 and a horizontal element 43 ending at the downstream cross piece 22, i.e., 32 - 34 of the downstream tank 14. The oblique parts 40 - 42 and the horizontal parts 41 - 43 are in the same vertical plane parallel to the axis (XX) and situted at one-fourth the useful length of the tank, i.e., of the length of the cathode. The lower horizontal element 39 is in a parallel plane situated approximately to the right of the upper quarter of the rear central part 17 of the upstream collector. The end of the rear end part 19 of the upstream collector of the upstream tank 13 is connected to the corresponding end of the upstream cross piece 21 of the downstream tank 14 by a rear end riser 23 comprising a horizontal element 44 and an oblique element 45. Of course, as the cross pieces are moveable, the risers are connected to it by flexible elements.

A series of these tanks having prebaked anodes, situated in transverse manner, the intensity circulating across the tanks being 175 kiloamperes, gives the following results:

- at the centre By = 1 gauss $\delta By/\delta z$ = 2,6 gauss meter;
- the maximum value of Bz in absolute value is 46 gauss on the large downstream side;
- the maximum value of Bxy, still in absolute value, is 153 gauss under the central riser; the upstream-downstream balancing of Bxy is good (the upstream and downstream fields are almost equal);
- the total weight of the conductors for a mean density of current of 30 amperes per square centimeter is 18.8 tonnes.

By way of comparison, a tank which is identical but supplied according to the first solution described above, i.e., by lateral risers on the heads, gives the following results:

- at the centre: By = 1 gauss, $\delta By/\delta z$ = 10 gauss/meter;
- Bz is low on the downstream side but high elsewhere, with a maximum in the upstream corner of 220 gauss;
- B*xy* is symmetrical upstream — downstream, with a maximum of 140 gauss under the central riser;
- the total weight of the conductors for the same mean density of current is 22.3 tonnes.

A tank which is identical but fitted according to the second solution described above, i.e., with two central risers situated at $\frac{1}{4}$ and $\frac{3}{4}$ of the large side of the tank, with the upstream negative collector passing round the head of the tank to return in the space between the downstream side tank towards the central riser of the following tank, gives the following results:

- at the centre: By = 42 gauss, $\delta By/\delta z$ = 6.25 gauss/-centimetre;
- Bz is low everywhere, except on the side where it reaches 47 gauss;
- Bxy is unbalanced upstream - downstream (98 against 196 gauss), the maximum being reached under the central riser with 196 gauss;
- the total weight of the conductors, for the same mean density of current of 30 A/cm2 is 21.9 tonnes.

The new method of supplying the tanks therefore permits by compensating the magnetic fields of the tanks and by partially compensating their derivatives, the fulfilment of the criteria of good operation of transverse tanks, namely:

zero field in the centre, ($\delta By/\delta z$) low at the centre, Bz minimal everywhere, Bxy minimal with equalibrium between upstream and downstream.

In addition, this arrangement brings two very important further advantages. A reduction of the length of the conductors which is translated by a gaining in weight of approximately 15% relative to the two prior solutions described and an improved distribution of the current in the cathode by reducing Jy, the negative connectors being in two or three parts per half tank instead of one in the case of the prior solutions.

The invention applies to the supply of electric current to igneous electrolysis tanks and more particularly to those intended for the manufacture of aluminium.

We claim:

1. A method for supplying electric current to transverse igneous electrolysis tanks which minimizes the effects of magnetic fields and applies to rectangular tanks connected in series for flow of electrical current from cathode of one tank to anode of the next tank comprising on the one hand a crucible of which the bottom constituting the cathode is formed from sealed carbon blocks on metal bars parallel to the small side of the tank, and on the other hand an anode formed from carbonaceous anodic blocks suspended from one or the other of the two metal cross pieces parallel to the large side of the tank, this method being characterized in that one anode cross piece of the downstream tank is supplied with current by conductors connected to the ends of the cathode bars on the downstream side of the downstream tank, the other anode cross piece of the downstream tank being supplied with current by one set of conductors connecting the other anode cross piece with one set of cathode bars from the upstream side and another set of conductors connecting another set of cathode bars from the upstream side of the upstream tank, one set of conductors passing about the outside of the upstream tank while the other set of conductors pass underneath the upstream tank whereby the magnetic fields created by the different supply conductors cancel one another out.

2. A method according to claim 1, characterised in that through two conductors passing under the tank the current issuing from the upstream ends of the cathodic bars of the upstream tank is collected and in that the first cross piece of the adjacent downstream tank is supplied through two risers situated on its upstream side, the rest of the current issuing through the upstream ends of the cathodic bars being collected by two conductors which pass around the heads of the tank on either side and supply the first cross piece of the downstream tank through two risers situated on each small side, finally the current issuing through the downstream ends of the cathodic bars being collected by two conductors which supply the second cross piece of the downstream tank through two risers situated on its upstream side.

3. A method according to claim 1, characterised in that the conductors passing underneath the tank are shifted towards the centre of the tank, relative to the anode bears which they supply.

4. A method according to one of claim 1 characterised in that the first cross piece of the downstream tank is the upstream cross piece, the second being the downstream cross piece.

5. A device for the implementation of the method of claim 1, comprising risers which are symmetrical two by two in relation to the common plane of symmetry (XX) of the tanks and connecting the cathodic collectors composed of two elements, one front, the other rear, of the upstream tank (13), to the cross pieces (21 and 22) of the downstream tank (14), characterized on the one hand in that each element of the upstream collector comprises a central part (17 or 18) and an end part (19 or 20), and on the other hand in that the risers are four in number, namely two end risers, one rear (23), the other front (24), connecting the ends of the outside parts (19 or 20) of the upstream collector of the upstream tank (13) to the ends of the upstream cross piece (21) of the downstream tank (14), and two central risers, one front, the other rear, each of which comprises two elements respectively (25 - 27 and 26 - 28) located substantially in one or the other of the two planes parallel to the plane (XX), these planes being situated respectively at $n$ and at $(1 - n)$ of the length of the cathodes and opposite the interruptions (17 - 19 and 18 - 20) between the central and end parts of the elements of the upstream collector, $n$ being a fraction between and $\frac{1}{4}$, the first element (25 or 26) of each riser starting from a point on the central part (17 or 18) of the upstream collector, passing underneath the upstream tank (15) and ending at the upstream cross piece (21), while the second element (27 or 28) starts from the corresponding element (15 or 16) of the downstream collector and ends at the downstream cross piece (22).

6. A device according to claim 5, characterised in that each upstream and downstream collector delivers an electric current equal to half the total current passing through the tank, the current circulating in each of the risers (25 and 26) passing under the upstream tank being between $\frac{1}{8}$ and 3/16 of the total current I; $\frac{1}{8}$ corresponding to $n = \frac{1}{4}$ while 3/16 corresponds to $n = \frac{1}{8}$.

7. A device according to claim 5, characterized in that the central riser element (25 or 26) passing underneath the upstream tank (13) is connected substantially to the center point of the central part (17 or 18) of the upstream collector.

* * * * *